US007841468B2

(12) United States Patent
Pendergraph et al.

(10) Patent No.: US 7,841,468 B2
(45) Date of Patent: Nov. 30, 2010

(54) ACCESSORY HOLDER

(75) Inventors: Melvin A. Pendergraph, Arlington Heights, IL (US); Joseph C. Serpico, Aurora, IL (US); Randy G. Rosebrook, Grayslake, IL (US)

(73) Assignee: Robert Bosch GmbH, Stuttgart, DE (US)

( * ) Notice: Subject to any disclaimer, the term of this patent is extended or adjusted under 35 U.S.C. 154(b) by 277 days.

(21) Appl. No.: 11/983,226

(22) Filed: Nov. 8, 2007

(65) Prior Publication Data

US 2009/0120822 A1 May 14, 2009

(51) Int. Cl.
*B65D 85/28* (2006.01)

(52) U.S. Cl. ..... 206/379; 206/372; 206/373; 206/349

(58) Field of Classification Search ..... 206/379, 206/372, 373, 370, 223, 231, 207, 579, 230, 206/349–383, 478, 480, 459.5, 462, 470; 211/69, 70

See application file for complete search history.

(56) References Cited

U.S. PATENT DOCUMENTS

| | | | | | |
|---|---|---|---|---|---|
| 2,513,894 | A | | 7/1950 | Rogers | |
| 2,530,024 | A | * | 11/1950 | Moody | 206/375 |
| 3,923,152 | A | | 12/1975 | Minneman | |
| 3,939,324 | A | * | 2/1976 | McDowell | 219/126 |
| 4,671,408 | A | | 6/1987 | Raines et al. | |
| 4,749,082 | A | | 6/1988 | Gardiner et al. | |
| 5,071,346 | A | * | 12/1991 | Domaas | 433/77 |
| 5,248,030 | A | * | 9/1993 | Tarozzi | 206/1.7 |
| 5,588,525 | A | | 12/1996 | Rosler | |
| D403,508 | S | | 1/1999 | Kheradpir et al. | |
| 5,918,741 | A | | 7/1999 | Vasudeva | |
| 5,979,649 | A | | 11/1999 | Rosler | |
| 6,152,299 | A | | 11/2000 | O'Malley et al. | |
| 6,206,189 | B1 | * | 3/2001 | Huot et al. | 206/379 |
| 6,241,092 | B1 | * | 6/2001 | Vasudeva | 206/349 |
| 6,626,295 | B1 | | 9/2003 | Vasudeva | |
| 7,306,099 | B2 | * | 12/2007 | Chen | 206/379 |
| 2003/0029756 | A1 | * | 2/2003 | Vasudeva et al. | 206/379 |

OTHER PUBLICATIONS

Patent Cooperation Treaty, International Search Report, Application No. PCT/US2008/082333, Dec. 29, 2008, 2 pages.

* cited by examiner

*Primary Examiner*—Mickey Yu
*Assistant Examiner*—Chun Cheung
(74) *Attorney, Agent, or Firm*—Maginot, Moore & Beck

(57) ABSTRACT

An accessory holder includes a first clamshell portion, a second clamshell portion, a living hinge joining the first and second clamshell for moving the first clamshell portion between a first position adjacent to the second clamshell portion wherein the first clamshell portion and the second clamshell portion define a first compartment for holding an accessory and a second position wherein the first clamshell portion is spaced apart from the second clamshell, a latch assembly having a first latch portion located on the first clamshell portion and a second latch portion located on the second clamshell portion for latching the first clamshell portion with the second clamshell portion when the first clamshell portion is in the first position and a cover for holding the first clamshell portion in the first position.

7 Claims, 4 Drawing Sheets

ACCESSORY HOLDER

FIELD OF THE INVENTION

This invention relates to the field of hand held rotary tools and related accessories.

BACKGROUND OF THE INVENTION

Hand held rotary tools are widely used by many people including professionals, craftspeople, homeowners, and artists. These rotary tools typically include an outer housing designed to be easily held within a human hand. The housing retains an electric motor which is operable to drive a rotatable chuck of the rotary tool. An accessory may be releasably secured to the chuck thereby enabling the rotary tool to rotatably drive the accessory.

The widespread use of hand held rotary tools is a result, in part, of the wide variety of accessories that may be used with the tools. The accessories include cut-off wheels, polishing wheels, grinding wheels, sanding discs, routing bits and other cutting bits. In addition to the availability of specialized types of shaping accessories, shaping accessories may further be specifically designed for the particular type of material that is to be shaped. For example, U.S. Pat. No. 6,758,639 assigned to Credo Technology Corporation discloses a bit that is designed for use with drywall.

While many of the accessories used with rotary tools are available in kits, the provision of every available accessory for a particular rotary tool is prohibitively expensive. Moreover, those accessories which are used more frequently by a particular consumer will need to be replaced due either to breakage or wear, while the accessories that are rarely if ever used need not be replaced. Thus, accessories are typically provided individually, even if the accessory is also provided within a kit. Thus, packaging for individual accessories is needed.

Additionally, while kits are frequently provided within a storage kit that the consumer may use, the individual accessories are frequently provided in simple packaging which is not intended to function as a permanent storage device. Thus, a consumer may simply keep the accessories in a drawer or storage bin with other accessories. For accessories which include cutting tips or blades, such storage can lead to dulling or even chipping of the cutting tip or blade. Accordingly, various accessory holders have been developed which provide for storage of the accessory by the consumer.

Individual accessory holders suffer from various limitations. For example, some of the accessory holders are opaque. Thus, the consumer cannot see the actual accessory. Accordingly, the consumer cannot tell by looking at the accessory holder whether or not the accessory is within the holder. Additionally, such accessory holders frequently use paper labels to identify the particular accessory. These labels can easily be damaged or worn such that the consumer is not able to read the label.

The storage problem for a consumer is further compounded by the fact that certain accessories require other devices to maintain or modify the accessory. One such accessory is a router bit. A router bit may include an accessory tool in the form of a bearing which is used to offset the working portion of the router bit from the work piece. Such router bits may use a variety of bearings to provide a variety of offsets which a consumer can interchange using an Allen wrench to remove one bearing and to mount another bearing. Additionally, the bearings tend to become unusable, necessitating replacement of the bearing in order to properly use the router bit. Thus, a single accessory bit may result in a need to store a number of additional accessory tools. Because of the size of the accessory tools, such as the bearings and the Allen wrench, these accessory tools are easily lost or misplaced.

In addition to a storage function, the packaging of an accessory may provide a display function. The manner in which various accessories are displayed, however, can result in consumer confusion. For example, the consumer may not be overly familiar with the capabilities of the particular accessory. Thus, while the consumer may realize that a router bit is needed for a particular project, the consumer may have difficulty recognizing the particular router bit that is needed since the bit is in essence a negative of the shape that is generated.

Additionally, packaging is usually provided that displays an accessory in a manner that is optimized for a retail setting. For example, retailers generally provide a large variety of accessories for a variety of rotary tools. Thus, since displaying the accessories on a shelf requires a substantial amount of space for a single item, some retailers prefer to display the accessories in a holder which can be hung from a rack. The consumer, however, rarely has a rack system to use when storing the accessory. Thus, the accessory holder is not easily incorporated into the consumer's storage scheme.

Accordingly, it would be advantageous to provide an accessory holder which allows the accessory to be displayed while hanging on a rack while further allowing storage of the accessory in an upright position wherein the accessory could be visually identified. It is further desired that the accessory holder provides for storage of components and tools used with the accessory.

SUMMARY OF THE INVENTION

Some limitations of previously known accessory holders may be overcome by an accessory holder that includes a first clamshell portion, a second clamshell portion, a living hinge joining the first and second clamshell for moving the first clamshell portion between a first position adjacent to the second clamshell portion wherein the first clamshell portion and the second clamshell portion define a first compartment for holding an accessory and a second position wherein the first clamshell portion is spaced apart from the second clamshell, a latch assembly having a first latch portion located on the first clamshell portion and a second latch portion located on the second clamshell portion for latching the first clamshell portion with the second clamshell portion when the first clamshell portion is in the first position and a cover for holding the first clamshell portion in the first position.

Another accessory holder incorporating principles of the invention includes a base formed from a first clamshell portion and a second clamshell portion, a hanger located at a first end portion of the base, plurality of feet located at the first end portion of the base, a first compartment within the base for holding an accessory and a cover configured to engage a second end portion of the base.

BRIEF DESCRIPTION OF THE DRAWINGS

The present invention may take form in various system components and arrangement of system components. The drawings are only for purposes of illustrating exemplary embodiments and are not to be construed as limiting the invention.

DESCRIPTION

Figure 1:
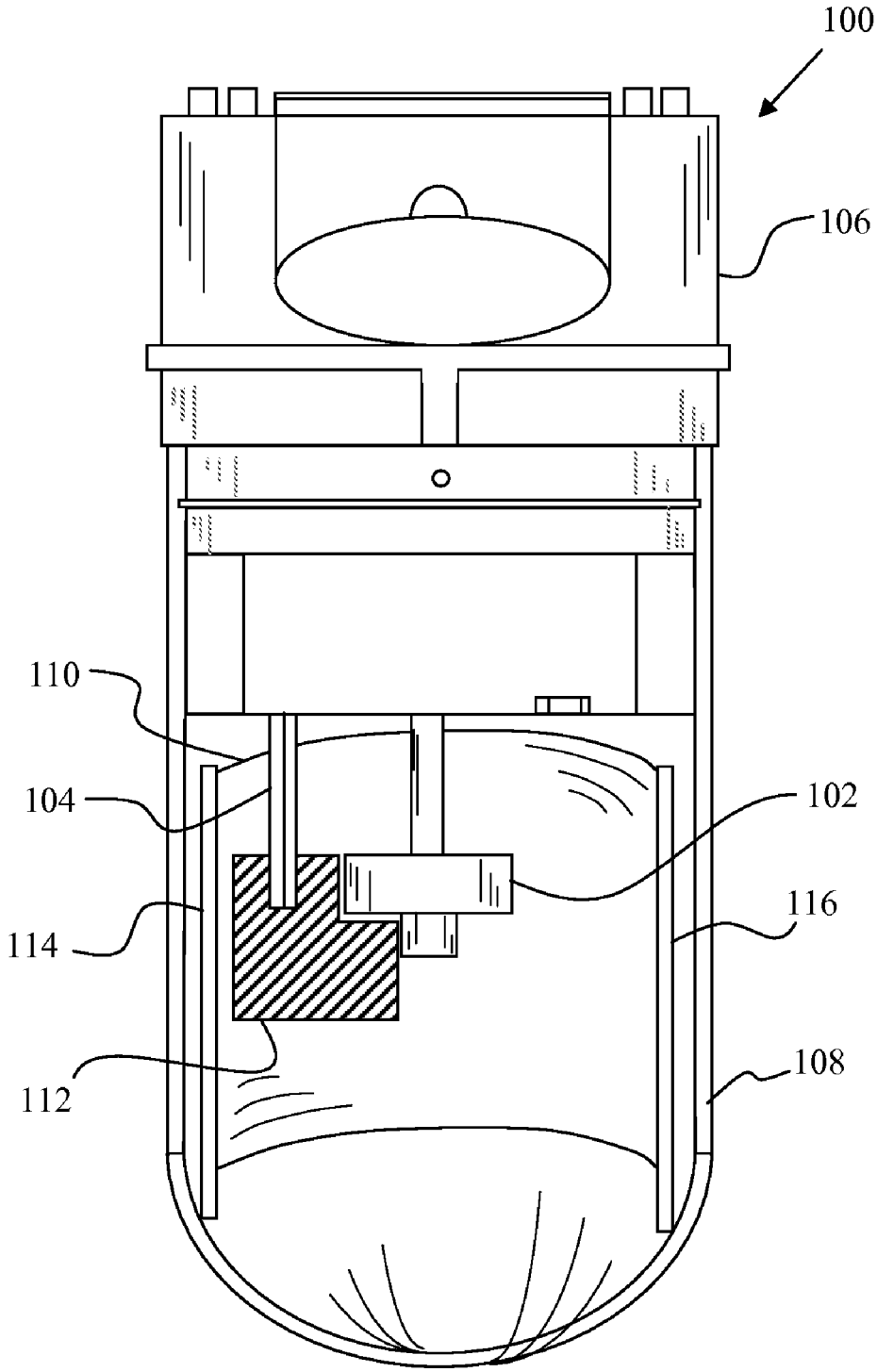
FIG. 1 shows a side plan view of an accessory holder in a hanging position with an accessory bit and an accessory tool held by a base portion including two clamshell portions and a cover maintaining the clamshell portions of the base adjacent to one another incorporating features of the present invention.
Figure 2:
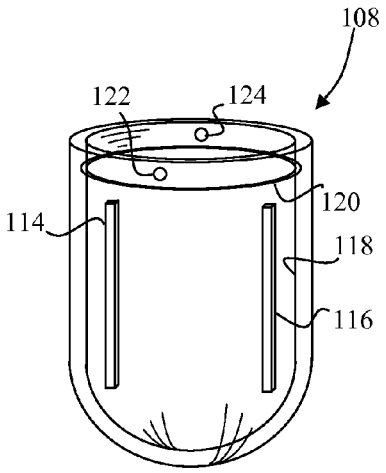
FIG. 2 shows a side perspective view of the label holders, detents and recess of the cover of the accessory holder of FIG. 1.

Referring to FIG. 1, an accessory holder 100 is shown holding an accessory bit 102 which in this embodiment is a routing bit, and an accessory tool 104. The accessory holder 100 includes a base portion 106 and a cover 108. A label 110 is positioned within the cover 108 and includes a diagram 112 of the shape of a cut that may be achieved using the accessory bit 102. The label 110 is held in position within the cover 108 by two label mounts 114 and 116 shown in FIG. 2 positioned on the inner surface 118 of the cover 108. A recess 120 extends about the inner surface 118 and two detents 122 and 124 are located between the recess 120 and a lip 126 at the upper portion of the cover 108. The cover 108 in this embodiment is molded from an acrylonitrile butadiene styrene (ABS) plastic. The ABS plastic in this embodiment is selected for a transmissivity which allows the particular accessory 102 to be visually identified when the cover 108 is positioned on the base portion 106.

Figure 3:
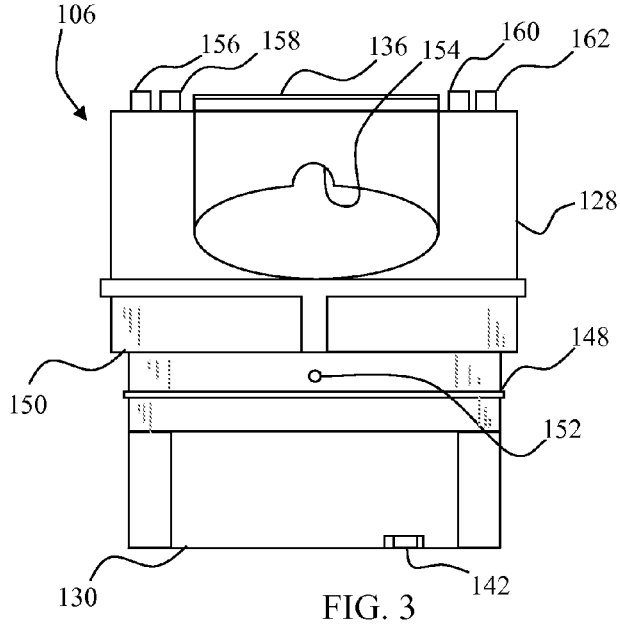
FIG. 3 shows a side plan view of the accessory holder of FIG. 1 with the cover removed.
Figure 4:
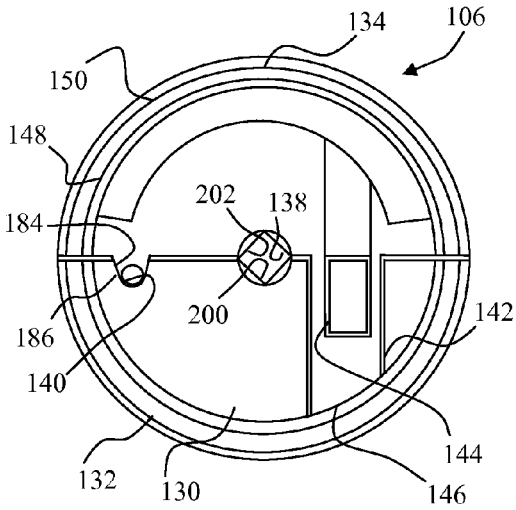
FIG. 4 shows a top plan view of the accessory holder of FIG. 1.

Referring to FIGS. 3 and 4, the outside 128 of the base portion 106 includes a platform 130 that is formed by two clamshell portions 132 and 134 which are joined by a living hinge 136. The living hinge 136 allows the clamshell portions 132 and 134 to be moved between a position wherein the clamshell portions 132 and 134 are spread apart as in FIG. 5 and a position wherein the clamshell portions 132 and 134 are adjacent to each other as shown in FIG. 4. The base 106 is formed from a polypropylene which allows the living hinge 136 to be subjected to a large number of cycles without failure.

When positioned adjacent to each other, the clamshell portions 132 and 134 define an accessory opening 138 and an accessory tool opening 140 through the platform 130. A latch assembly 142 is also located on the platform 130 and includes a base 144 located on the clamshell portion 132 and a catch 146 which is attached to the clamshell portion 134 and extends over the clamshell portion 132. The base 106 further includes a retention member 148, an eaves 150, two recesses 152 (only one recess is shown) and a hanger 154.

Figure 5:
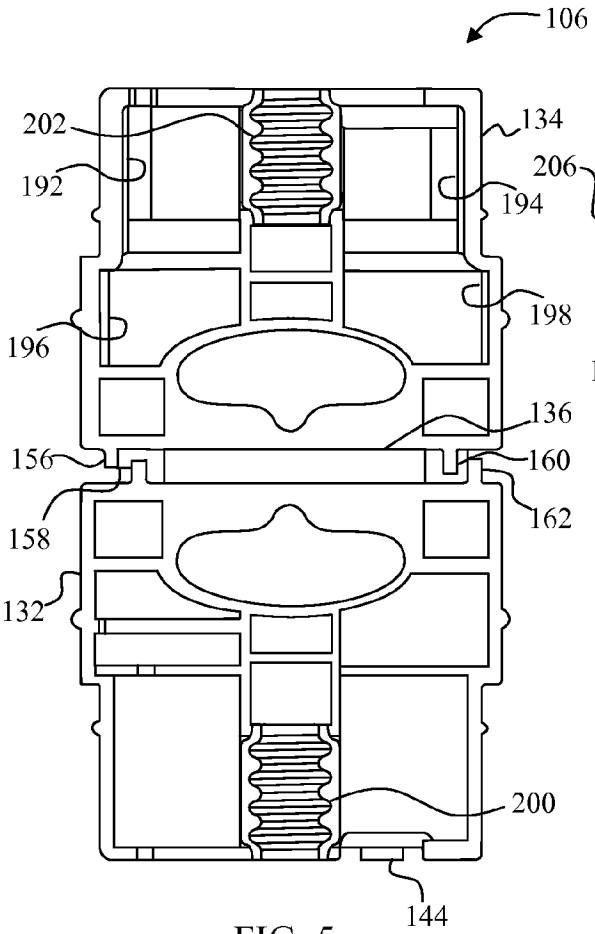
FIG. 5 shows a plan view of the base portion of the accessory holder of FIG. 1 with the base portion opened to reveal cavities formed in the clamshell portions and inserts positioned within two of the cavities.

The upper portion of the accessory holder 100 also includes and four feet 156, 158, 160 and 162. As shown in FIG. 3, the feet 156, 158, 160 and 162 are offset from each other. This allows the feet 156, 158, 160 and 162 to extend beyond the center line of the living hinge 136 when the clamshell portions 132 and 134 are spread apart as shown in FIG. 5. Accordingly, when the clamshell portions 132 and 134 are adjacent to each other, the feet 156, 158, 160 and 162 extend farther in a direction away from the hanger 154 than the living hinge 136. This allows the accessory holder 100 to be positioned on the feet 156, 158, 160 and 162 as discussed further below.

Referring to FIGS. 5-8, within the base 106, the clamshell portions 132 and 134 define a number of cavities. The base 106 is configured such that when the clamshell portion 132 is positioned adjacent to the clamshell portion 134, the cavities 164, 166, 168 and 170 in the clamshell portion 132 align with the cavities 172, 174, 176 and 178 in the clamshell portion 134, respectively, to form compartments. The compartments are identified herein by the cavities which define the compartment. Thus, the compartment defined by the cavities 164 and 172 is the 164-172 compartment.

In this embodiment, some of the compartments are formed symmetrically. By way of example, the structure defining the cavity 180 is symmetrical to the structure defining the cavity 182. Thus, when the clamshell portion 132 is adjacent to the clamshell portion 134, the clamshell portions abut 132 and 134 abut each other such that the 180-182 compartment is fully enclosed. Similarly, the structure defining the cavity 166 is symmetrical to the structure defining the cavity 174. Thus, each of the clamshell portions 132 and 134 define symmetrical portions of the 166-174 compartment and of the accessory opening 138 that is formed when the clamshell portion 132 is adjacent to the clamshell portion 134.

The structure of the clamshell portion 132 and the structure of the clamshell portion 134 are not, however, completely symmetrical. For example, the accessory tool opening 140 is formed using an extension 184 in the clamshell portion 134 that fits into a recess 186 in the clamshell portion 132. This allows the accessory tool 104 to be accommodated by joining the cavities 164 and 168 with a recess 188 while movement of the accessory tool 104 into the base 106 is limited by a rib 190 that has no corresponding structure on the clamshell portion 134.

Additionally, guides 192, 194, 196 and 198 extend outwardly from the clamshell portion 134. Accordingly, when the clamshell portion 132 is adjacent to the clamshell portion 134, the guides 192, 194, 196 and 198 extend into cavities within the clamshell portion 132. The guides are configured to abut the walls of the cavities to provide increased strength and protect the living hinge 136 from twisting forces that could damage the living hinge 136.

Figure 7:
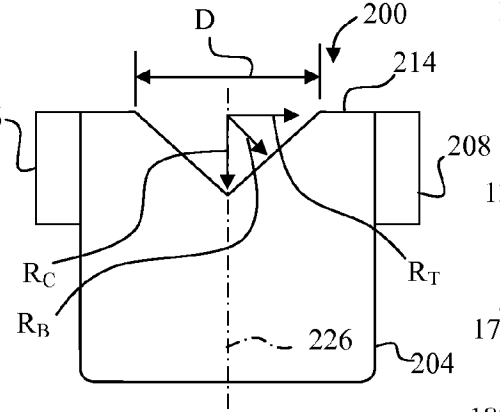
FIG. 7 shows a side plan view of the insert of FIG. 5 which is used to clamp an accessory.
Figure 8:
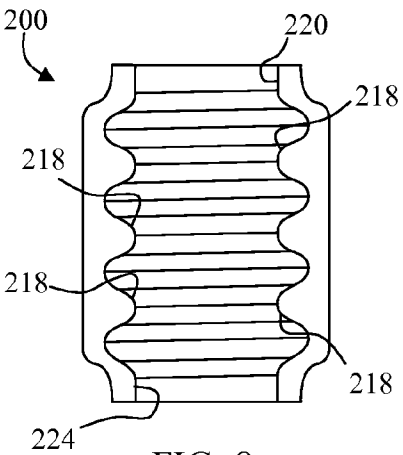
FIG. 8 shows a top plan view of the insert of FIG. 7.

The cavities 166 and 174 are configured to receive two inserts 200 and 202. The inserts 200 and 202 are made from a resilient non-slip thermoplastic elastomer. With reference to FIGS. 7 and 8, the insert 200, which in this embodiment is identical to the insert 202, includes a lower portion 204 that is configured to fit snugly within the cavity 166 and two rims 206 and 208 which are configured to sit on top of recessed ribs or walls 210 and 212 shown in FIG. 6. The insert 200 is sized such that when the insert is positioned within the cavity 166, the top portion 214 of the insert 200 is substantially coplanar with the non-recessed ribs in the clamshell portion 132.

The insert 200 includes a number of inner lips 218 and outer lips 220 and 224. The lips 218, 220 and 224, define a diameter (D) at the top portion 214 of the insert 200 that is substantially the same as the diameter of the accessory opening 138. The lips 218, 220 and 224 are not circular like the accessory opening 138. Rather, a ray from the center line 226 at the top portion 214 of the insert 200 ($R_T$) of the lips 218, 220 and 224 is about ½ D. Likewise, a ray along the center line 226 ($R_C$) is about ½ D. Between the rays $R_T$ and $R_C$, however, the lengths of the rays ($R_B$) are less than ½ D. Thus, the inserts 200 and 202 define a square when viewed through the platform 130 as shown in FIG. 4.

Figure 9:
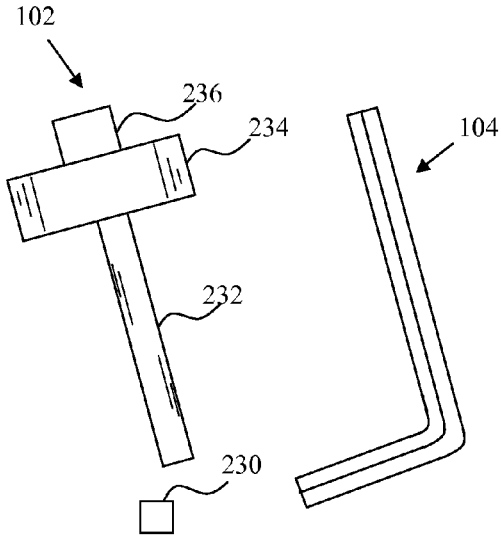
FIG. 9 shows an elevational view of the accessory bit and two accessory tools that may be stored in the accessory holder of FIG. 1.
Figure 6:
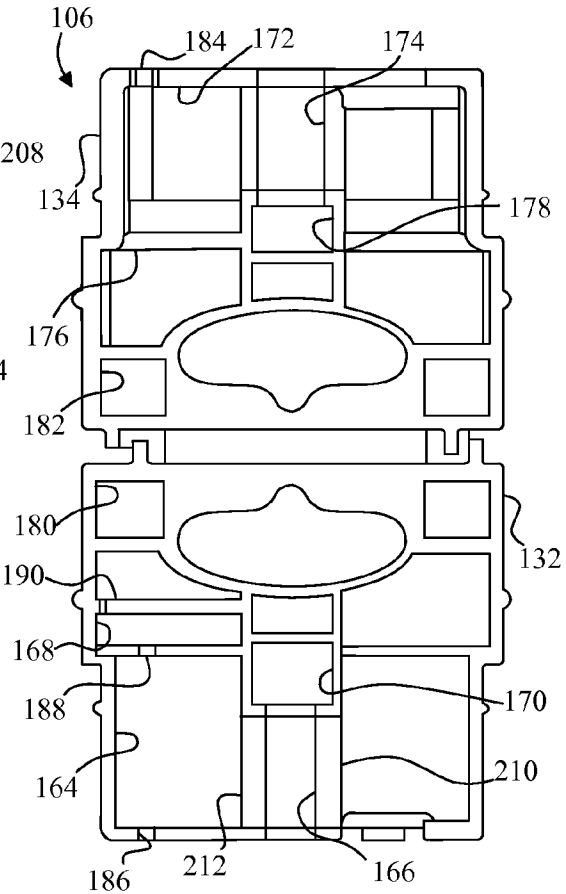
FIG. 6 shows a plan view of the base portion of the accessory holder of FIG. 1 with the base portion opened to reveal cavities formed in the clamshell portions with the inserts removed from the two cavities.

The accessory bit 102 and the accessory tool 104 are shown in FIG. 9 with an accessory tool bearing 230 that may be stored in the accessory holder 100. The accessory bit 102 includes a shaft 232, a work portion 234 and an accessory bearing 236. The accessory tool 104, which in this embodiment is an Allen wrench, includes a handle portion 238 and a work portion 240. The accessory tool 104 is used to remove the accessory bearing 236 from the accessory 102 and to attach the accessory bearing 230 to the accessory 102.

Figure 10:
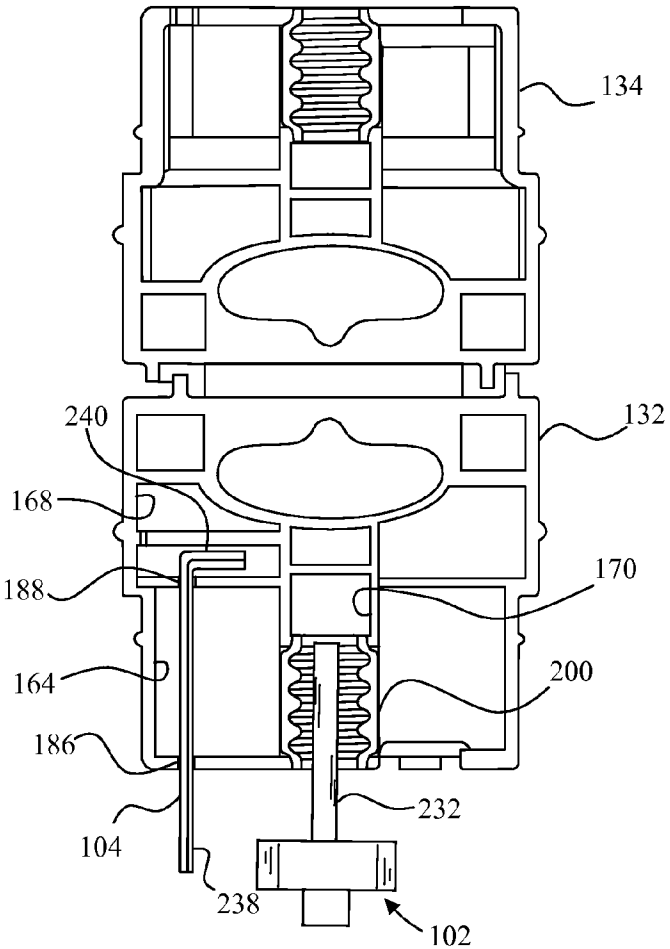
FIG. 10 shows an elevational view of the base of FIG. 5 with the accessory bit and two accessory tools of FIG. 9 positioned upon one of the clamshell portions.

To store the accessory 102 in the accessory holder 100, the inserts 200 and 202 are placed into the compartments in the clamshell portions 200 and 202, respectively as shown in FIG. 5. The inserts 200 and 202 are selected such that when the clamshell portion 134 is adjacent to the clamshell portion 132, a combined radius $R_B$ of the inserts 200 and 202 is less than the diameter of the shaft 232. Accessories or RFID devices may also be placed within the base 106 at this time. In this example, the bearing component 230 is positioned within the cavity 170 and the Allen wrench accessory tool 104 is positioned with the work portion 240 within the compartment 168 and the handle portion 238 extending through the recess 188, through the compartment 164 and out of the recess 186. Additionally, the shaft 232 of the accessory bit 102 is positioned on top of the insert 200, resulting in the configuration shown in FIG. 10.

Next, the clamshell portion 134 is rotated about the living hinge 136 to a position adjacent to the clamshell portion 132. As the clamshell portion 134 is rotated, the feet 156, 158, 160 and 162 are rotated to a position wherein they extend farther away from the base 106 than the living hinge 136. Additionally, the inserts 200 and 202 are rotated into contact with the shaft 232 as the cavities 164, 166, 168 and 170 are rotated into positions adjacent the cavities 172, 174, 176 and 178, respectively.

Figure 11:
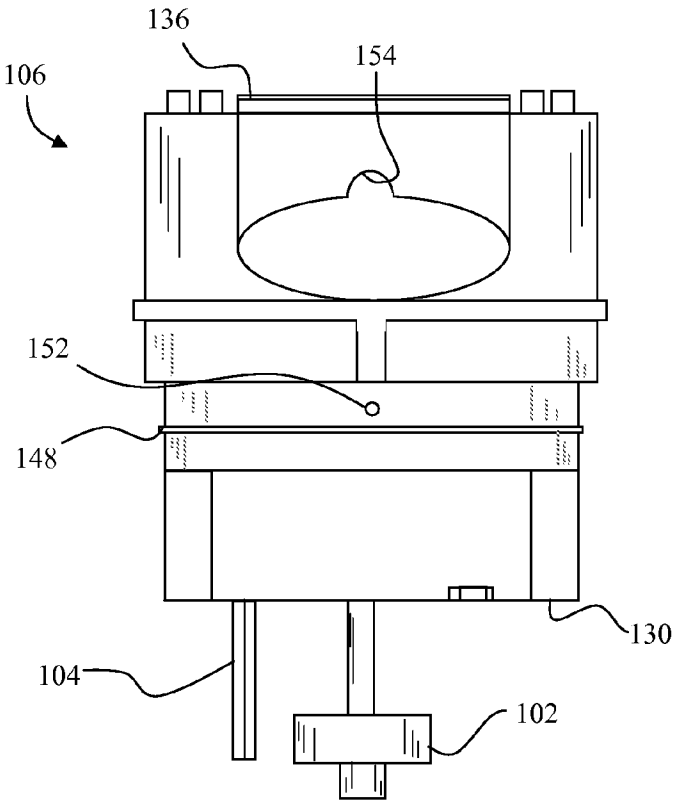
FIG. 11 is a side plan view of the accessory bit and two accessory tools of FIG. 9 positioned within the base of FIG. 5 with the clamshell portions of the base latched in a position adjacent to each other.

Accordingly, the accessory bearing 230 is securely held within the 170-178 compartment. Additionally, the accessory tool 104 is constrained from movement outwardly from the base 106 because the work portion 240 is entrapped within the 168-176 compartment. Moreover, because a combined radius $R_B$ of the inserts 200 and 202 is less than the diameter of the shaft 232, the lips 218, 220 and 224 and the lips of the insert 202 are pressed against the shaft 232 on opposing sides of the shaft 232. Thus, the shaft 232 is securely held within the tool holder 100. The catch 146 is then pushed down over the base 144 thereby latching the two clamshell portions 132 and 134 together as shown in FIG. 11.

Next, the cover 108 is positioned over the base 106. As the cover 108 is positioned over the base 106, the lip 126, which has a diameter slightly less than the diameter of the retention member 148, flexes along with the retention member 148 to allow the lip 126 to pass over the retention member 148. The distance between the lip 126 and the recess 120 is about the same as the distance between the eaves 150 and the retention member 148. Thus, as the lip 126 comes to a position adjacent to the eaves 150, the recess 120 is positioned adjacent to the retention member 148. The recess 120 is sized to receive the retention member 148. Accordingly, as the recess 120 is positioned adjacent to the retention member 148, the cover retention member 148 is received into the recess 120 and the cover 108 and the retention member 148 flex toward their original shapes.

The detents 122 and 124 are spaced apart from the lip 126 about the same distance as the recesses 152 are spaced apart from the eaves 150. Additionally, the recesses 152 are sized to receive the detents 122 and 124. Accordingly, if the detents 122 and 124 are aligned with the recesses 152, as the retention member 148 is received into the recess 120 the detents 122 and 124 will be received into the recesses 152.

In the event the detents 122 and 124 are not aligned with the recesses 152, the cover 108 will retain some amount of flexure. Rotation of the cover 108 about the base 106, however, will bring the detents 122 and 124 into alignment with the recesses 152 and the detents 122 and 124 will be received into the recesses 152. In this embodiment, the detents 122 and 124 and the recesses 152 are configured to position the label mounts 114 and 116 such that a label held by the label mounts 114 and 116 will be generally aligned with the hanger 154 as shown in FIG. 1.

Because the cover 108 is engaged with the base 106 by the reception of the retaining member 148 into the recess 120 and the reception of the detents 122 and 124 into the recesses 152, the cover will not slide off of the base 106 without force being applied. Additionally, the cover 108 encircles both the clamshell portion 132 and the clamshell portion 134. Accordingly, the clamshell portion 132 and 134 cannot be moved from a position adjacent to each other so long as the cover 108 remains on the base 106.

Thus, the accessory bit 102 and the accessory tool 104 are viewable through the cover 108 and securely gripped within the base 106 by the inserts 200 and 202. Additionally, the label 110 is positioned behind the accessory bit 102 and the diagram 112 is positioned behind the work portion 234 of the accessory bit 102. The accessory holder 100 may then be placed on display by hanging the accessory holder 100 by the hanger 154. Alternatively, the feet 156, 158, 160 and 162 may be placed on a flat surface such that the cover 108 is above the base 106.

Removal of the accessory bit 102, the accessory tool or the accessory bearing 230 may be accomplished by reversal of the steps set forth above.

While the present invention has been illustrated by the description of exemplary system components, and while the various components have been described in considerable detail, applicant does not intend to restrict or in any limit the scope of the appended claims to such detail. Additional advantages and modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

The invention claimed is:

1. An accessory holder comprising:

a first clamshell portion;

a second clamshell portion;

a living hinge joining the first and second clamshell for moving the first clamshell portion between a first position adjacent to the second clamshell portion wherein the first clamshell portion and the second clamshell portion define a first compartment for holding a first accessory for a rotary tool and a second position wherein the first clamshell portion is spaced apart from the second clamshell;

a latch assembly having a first latch portion located on the first clamshell portion and a second latch portion located on the second clamshell portion for latching the first clamshell portion with the second clamshell portion when the first clamshell portion is in the first position; and a cover for holding the first clamshell portion in the first position, wherein the first compartment comprises a first opening through which a portion of the first accessory may extend, wherein the cover comprises a transparent material, such that when the first clamshell portion is held in the first position and the first accessory extends out of the first opening, the first accessory is covered by and viewable through the cover, wherein the living hinge is configured such that when the first clamshell portion is in the first position, the living hinge defines a hanger, wherein the living hinge joins a first side of the first clamshell portion and a first side of the second clamshell portion, and wherein the first opening is located at a second side of the first clamshell portion and a second side of the second clamshell portion.

2. The accessory holder of claim 1, wherein:

the first side of the first clamshell portion comprises a first foot; and the first side of the second clamshell portion comprises a second foot, the first foot and the second foot configured such that when the first clamshell is in the first position, the accessory holder can be placed on the first foot and the second foot.

3. An accessory holder comprising:

a first clamshell portion;

a second clamshell portion;

a living hinge joining the first and second clamshell for moving the first clamshell portion between a first position adjacent to the second clamshell portion wherein the first clamshell portion and the second clamshell portion define a first compartment for holding a first accessory for a rotary tool and a second position wherein the first clamshell portion is spaced apart from the second clamshell;

a latch assembly having a first latch portion located on the first clamshell portion and a second latch portion located on the second clamshell portion for latching the first clamshell portion with the second clamshell portion when the first clamshell portion is in the first position; and a cover for holding the first clamshell portion in the first position, wherein the first compartment is defined at least in part by a gripper, the compartment sized such that when a portion of an accessory is located within the first compartment, the portion of the accessory is frictionally held by the gripper, and wherein the gripper comprises a first resilient portion coupled with the first clamshell portion, and a second resilient portion coupled with the second clamshell portion.

4. A rotary tool accessory holder comprising:

a base formed from a first clamshell portion and a second clamshell portion;

a hanger located at a first end portion of the base;

a plurality of feet located at the first end portion of the base;

a first compartment within the base for holding a rotary tool accessory;

a cover configured to engage a second end portion of the base;

a first resilient insert coupled with the first clamshell portion and located within the first compartment; and a second resilient insert coupled with the second clamshell portion and located within the first compartment.

5. The accessory holder of claim 4, wherein:

the first resilient insert comprises at least one first lip extending along a cavity, the at least one first lip including a first gripper portion located between a first end portion and a center portion, and a second gripper portion located between a second end portion and the center portion; and the second resilient insert comprises at least one second lip extending along a cavity, the at least one second lip including a third gripper portion located between a first end portion and a center portion, and a fourth gripper portion located between a second end portion and the center portion, such that when the first clamshell portion and the second clamshell portion are adjacent to each other the first insert cavity and the second insert cavity form a compartment wherein:

the first gripper portion is located at a position within the compartment generally opposite the third gripper portion;

the second gripper portion is located at a position within the compartment generally opposite the fourth gripper portion;

the first end portion of the at least one first lip is adjacent to the first end portion of the at least one second lip;

the second end portion of the at least one first lip is adjacent to the second end portion of the at least one second lip; and the distance between the first gripper portion and the third gripper portion and the distance between the second gripper portion and the fourth gripper portion are less than the distance across the compartment between the first end portion of the at least one first lip and the second end portion of the at least one second lip.

6. A rotary tool accessory holder comprising:

a base formed from a first clamshell portion and a second clamshell portion;

a hanger located at a first end portion of the base;

a plurality of feet located at the first end portion of the base;

a first compartment within the base for holding a rotary tool accessory;

a cover configured to engage a second end portion of the base;

a first label mount positioned on the inner surface of the cover; and a second label mount positioned on the inner surface of the cover and spaced apart from the first label mount.

7. The accessory holder of claim 6, wherein the cover further comprises:

a recess for receiving a retention member, the recess circumscribing the inner surface of the accessory holder; and a detent for insertion into a recess on the base, the detent positioned such that when the detent is received into the recess, the label mounts are aligned with the hanger.

* * * * *